US005134790A

United States Patent [19]

Woitschaetzke et al.

[11] Patent Number: 5,134,790

[45] Date of Patent: Aug. 4, 1992

[54] SHOE, ESPECIALLY A SPORT SHOE

[75] Inventors: Hans Woitschaetzke, Gruenwald; Udo Flemming, Erlangen, both of Fed. Rep. of Germany

[73] Assignee: Tretorn AB, Helsingborg, Sweden

[21] Appl. No.: 542,001

[22] Filed: Jun. 22, 1990

[51] Int. Cl.[5] ..... A43B 13/12

[52] U.S. Cl. ..... 36/28; 36/30 R

[58] Field of Search ..... 36/28, 29, 30 R, 37, 36/93

[56] References Cited

U.S. PATENT DOCUMENTS

| | | | |
|---|---|---|---|
| 532,429 | 1/1895 | Rogers | 36/28 |
| 1,304,915 | 5/1919 | Spinney | 36/29 |
| 1,370,798 | 3/1921 | Egerton | 36/30 R |
| 1,559,532 | 10/1925 | Smith | 36/28 |
| 1,994,681 | 3/1935 | Blumenfeld | 36/28 X |
| 3,205,595 | 9/1965 | Funck | 36/30 R |
| 3,273,265 | 9/1966 | Reinert et al. | 36/30 R |
| 3,418,731 | 12/1968 | Anciaux | 36/30 R |
| 4,129,951 | 12/1978 | Petrosky | 36/29 |
| 4,229,889 | 10/1980 | Petrosky | 36/29 X |
| 4,485,568 | 12/1984 | Landi et al. | 36/44 |
| 4,535,553 | 8/1985 | Deiderian et al. | 36/29 X |
| 4,547,978 | 10/1985 | Radford | 36/3 B |
| 4,774,774 | 10/1988 | Allen, Jr. | 36/28 |
| 4,793,078 | 12/1988 | Andrews | 36/44 X |
| 4,845,861 | 7/1989 | Moumdjian | 36/29 |
| 4,888,887 | 12/1989 | Solow | 36/29 X |
| 4,894,932 | 1/1990 | Harada et al. | 36/29 X |

FOREIGN PATENT DOCUMENTS

| | | | |
|---|---|---|---|
| 1287477 | 1/1969 | Fed. Rep. of Germany | 36/29 |
| 3423693 | 1/1985 | Fed. Rep. of Germany | 36/29 |
| 138794 | 2/1920 | United Kingdom . | |
| 1080926 | 8/1967 | United Kingdom | 36/29 |

*Primary Examiner*—Paul T. Sewell
*Assistant Examiner*—Ted Kavanaugh
*Attorney, Agent, or Firm*—Sixbey, Friedman, Leedom & Ferguson

[57] ABSTRACT

A shoe, especially a sport shoe, with a shoe sole, which is composed of an outsole, a midsole of elastically springy material and an insole, and a honeycomb body with cell walls oriented approximately perpendicular to the shoe outsole, is improved so that additional damping, especially at the moment that the shoe sole engages on the ground is made possible. This is achieved in that a honeycomb is incorporated into the midsole, as a part of the midsole itself or as a sole part connected or inserted in the midsole has cell walls that are gas-permeable so as to enable gas to be exchanged between adjacent honeycomb cells.

25 Claims, 2 Drawing Sheets

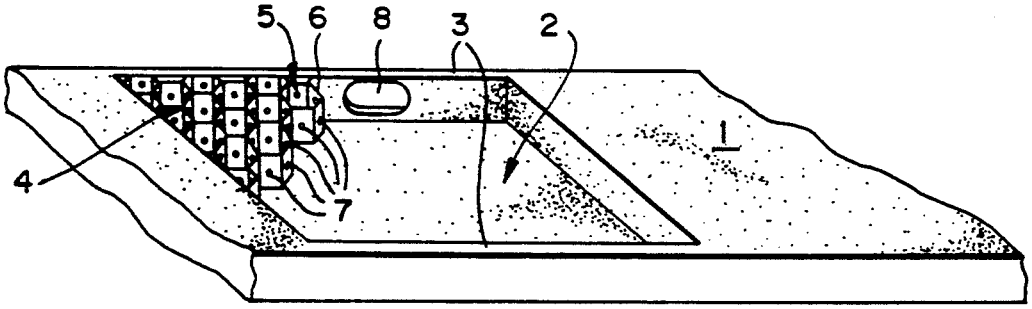
FIG. 1
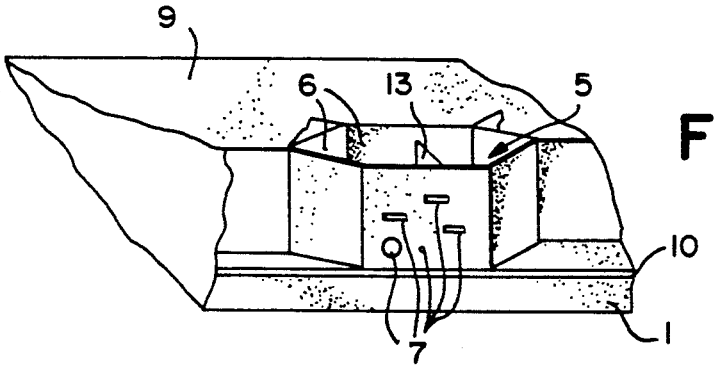
FIG. 2
FIG. 3
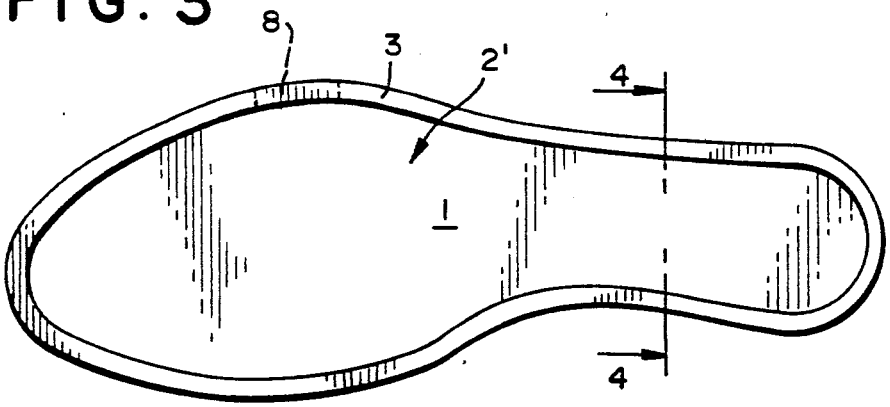
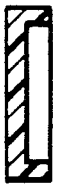
FIG. 4
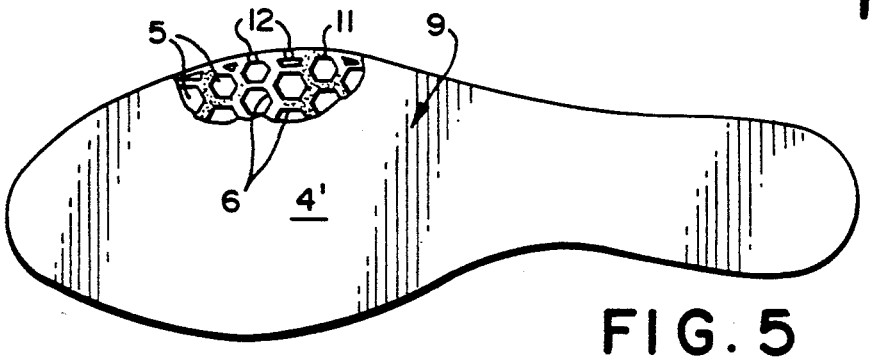
FIG. 5

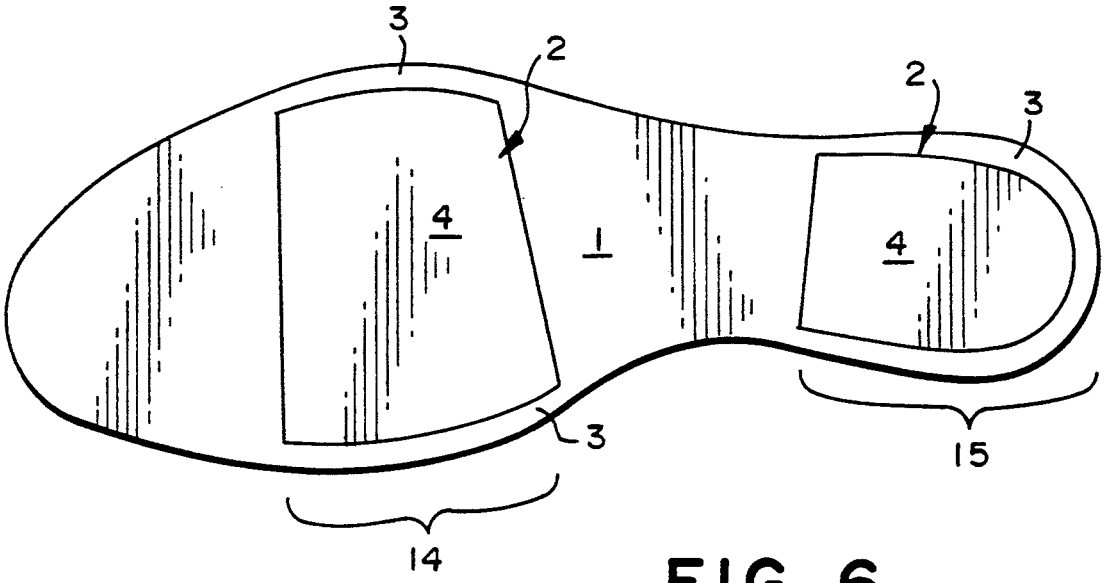
FIG. 6
FIG. 7
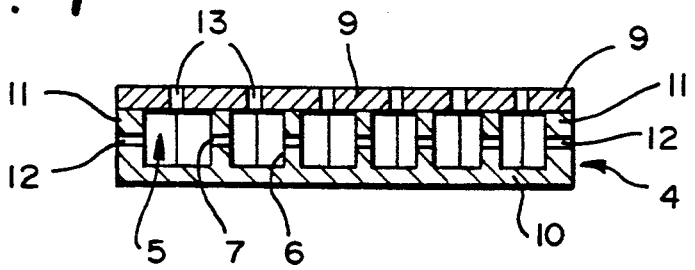
FIG. 8
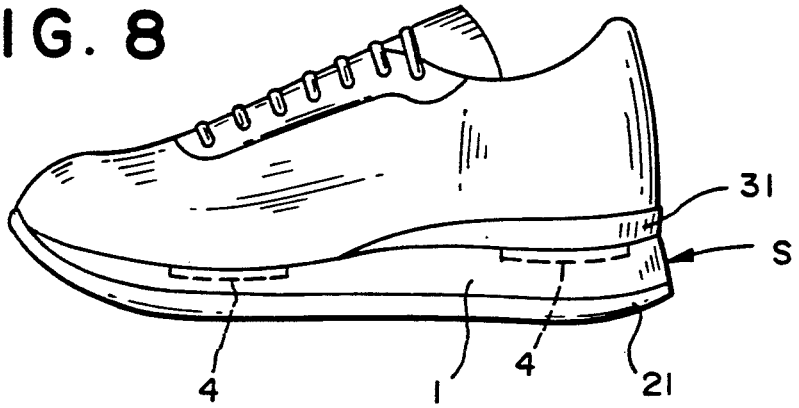

SHOE, ESPECIALLY A SPORT SHOE

BACKGROUND OF THE INVENTION

The invention relates to a shoe, especially a sport shoe, with a shoe sole, which is composed of an outsole, a midsole of elastically springy material, an insole, and a honeycomb body with cell walls that are oriented at least approximately perpendicular to the shoe outsole.

A sole for such a shoe, especially a sport shoe, is known from U.S. Pat. No. 4,485,568 to Landi et al. The honeycomb body consists of rectangular honeycomb cells, whose longitudinal and crosswise sides (cell walls) run perpendicular to the outsole surface. As a result, the sole has good lateral stability. The honeycomb body can be used as an insole, midsole or outsole. The upper surface of the honeycomb body is covered with a gas-permeable, especially perforated covering element. As a result, a gas exchange in the shoe interior, but not from cell to cell, is possible. Therefore, with this type of sole, it is disadvantageous that, even though air circulation in the sense of an aeration of the interior of the shoe is achieved, additional damping effect, especially in the edge areas of the honeycomb body, is not achieved.

U.S. Pat. Nos. 532,429 (Rogers) and 1,559,532 (Smith) show shoe soles with honeycomb cushioning bodies formed, respectively, as integral formations in ball and forefoot regions of an insole sole or as inserts of an outsole, respectively, while Byrne, U.K. Patent Specification No. 138,794, shows air cushion cells formed integrally within these regions of an outsole. However, no means for gas exchange between cells exists, so that compression of highly stressed cells does not bring about an increase in damping force in less highly stressed cells.

A pneumatic insole is known from U.S. Pat. No. 1,304,915 to Spinney having a series of elongated chambers which run in a lengthwise direction of the sole in its forefoot region and crosswise in the remaining portion of the sole, or where all of the chambers run in a crosswise direction of the sole. A restricted movement of air from chamber-to-chamber is obtained via the provision of a small opening through the center of the chamber walls. However, because of the configuration, size and number of the chambers together with the location of the openings, the exchange of air between adjacent chambers cannot readily adapt to variations in loading or bring about an increased lateral stabilization of the foot upon engagement of the sole with the ground. Additionally, such a chambered sole does not possess the stability of a honeycomb body.

SUMMARY OF THE INVENTION

A primary object of this invention is to make possible a controlled damping and lateral stabilization, especially at the moment that the shoe sole engages on the ground, while also making a gas exchange with the outside atmosphere possible.

This object is achieved by incorporating a honeycomb body into the midsole, either as a part of the midsole itself or via a sole part that is connected or inserted in the midsole, which has cell walls that are gas-permeable so as to enable gas to be exchanged between adjacent cells of the honeycomb. This invention makes it possible that, at the time that the shoe sole engages the ground, in the areas of high support pressure, where the highest impact loading occurs, the air is pressed from the honeycomb cells so stressed into honeycomb cells receiving less pressure stress.

Thus, at first, a damping is achieved which is dependent, from a practical standpoint, only on the properties of the material of which the honeycomb is formed and such structural characteristics of the honeycomb body, as its area and height, and the thickness of the cell walls. But, at the same time or immediately afterwards, in the less stressed honeycomb cells, a momentary excess pressure is produced, which guarantees a lateral stabilization of the honeycomb body at the most important moment of the stepping of the foot on the honeycomb body. Furthermore, a throttling effect causes a momentary additional damping, comparable to that of an essentially gas-tight gas cushion.

These and further objects, features and advantages of the present invention will become more obvious from the following description when taken in connection with the accompanying drawings which show, for purposes of illustration only, several embodiments in accordance with the present invention.

BRIEF DESCRIPTION OF THE DRAWINGS

FIG. 1 shows, in perspective, a portion of a midsole with a recess into which a honeycomb body, only a portion of which is illustrated, is inserted;

FIG. 2 is an enlarged view of a honeycomb cell located in an edge area of the midsole of FIG. 1;

FIG. 3 is a top view of a midsole;

FIG. 4 is a cross-sectional view taken along the section line IV—IV of FIG. 3;

FIG. 5 is a top view of a partially opened honeycomb body for use in the recess of the midsole according to FIGS. 3 and 4;

FIG. 6, a top view of a midsole with a recess in each of the ball and heel of the foot;

FIG. 7 is a cross section through another embodiment of a honeycomb body in accordance with the present invention; and FIG. 8 is a side elevational view of a shoe in accordance with the present invention;

DETAILED DESCRIPTION OF THE PREFERRED EMBODIMENTS

FIG. 1 indicates a midsole 1 for a shoes S (FIG. 8), whose sole consists of an outsole 21, midsole 1, and an insole 31. In FIG. 1 only a section of the midsole 1 is represented.

In midsole 1 is a recess 2, which is limited laterally by an edge 3 of the material of midsole 1. Advantageously, edge 3 has a width (i.e., thickness crosswise of the sole) of about 2 mm to 10 mm, and preferably, of about 4 mm to 8 mm. A honeycomb body 4 of elastic, compressible or elastically springy material is provided, for example, inserted and optionally glued in recess 2. Only a portion of honeycomb body 4, which preferably is designed as a homogeneous molded article sized to fit recess 2, is represented in FIG. 1.

Honeycomb body 4 is comprised of honeycomb cells 5, which are formed by cell walls 6. In the illustrated embodiment, hexagonal honeycomb cells 5 are present as an example only and the cell can be of any other desired shape. According to the invention, preferably all cell walls 6 are made gas-permeable by being provided with at least one opening 7 in each of the cell walls 6. As a result, the gaseous atmosphere inside of all of the honeycomb cells 5 is interconnected. The gas permeability of individual cell walls 6 can also be achieved by cell walls 6 consisting of a porous material, for example, of open-pore foam.

In cell walls 6 formed of a gas-impermeable material, at least one opening 7 must be provided and these openings 7 can be made round, rectangular, slot-shaped or also oval, and also several, optionally different-sized, openings 7 can be provided per cell wall 6 as shown in FIG. 2. Openings 7 have a diameter of 0.1 mm to 2 mm, a slot width or slot height of 1 mm to 3 mm or a surface area of about 0.0075 $mm^2$ to 3.0 $mm^2$.

The small size of the openings produces a throttling effect, which causes a momentary additional damping effect comparable to that of an essentially gas-tight gas cushion, after which the gas can migrate to the less stressed areas (which will be in the edge areas) to increase total stability . Honeycomb body 4 is closed at the top and bottom with a respective covering element 9 or 10. The covering elements 9, 10 can be layer formed of a sheet or slab between 0.1 mm and 3 mm thick The lower covering element 10 can be formed as an integral injection molded part of the honeycomb that closes the bottom side of honeycomb body 4.

As a material for honeycomb body 4, natural or synthetic rubber is preferred, or plastics, such as polyurethane, polyvinyl acetate, polyamide, polyamide or the like, can be used.

Optionally, edge 3 of midsole 1 can be provided with one or more openings 8. As a result, honeycomb cells 5 are also connected to the outside atmosphere.

FIG. 3 shows the top of a midsole 1' in which a single recess 2' extends over substantially the entire surface of the midsole, front-to-back and side-to-side, so that only a peripheral edge 3' of about 2 mm to 10 mm across, especially of about 4 mm to 8 mm, and a height which corresponds to the thickness of a honeycomb body 4' matched to recess 2' of FIG. 3. FIG. 4 shows the cross section of this midsole along sectional plane IV—IV.

From the section of honeycomb body 4' represented in FIG. 5 without upper covering element 9, it can be seen that honeycomb body 4, has a peripheral edge wall 11, which closes all the outside cells. Edge wall 11 can be made gas-impermeable over its entire periphery, but parts of edge wall 11 can also be made gas permeable for connection with one or more openings 8 in edge 3 of midsole 1. For this purpose, edge wall 11 Can be porous at the appropriates places, for example, can consist of open-pore cell material or can be provided with individual openings 12. This, a lateral gas exchange with the atmosphere is also made possible.

To achieve a ventilation of the foot or the inside of the shoe, upper covering element 9 can consist of a gas-permeable material, for example, an open-pore foam or a felt or other nonwoven fabric, or covering element 9 can be perforated. In such a case, at least one opening 13 is provided per honeycomb cell 5 (cf. FIG. 7). These openings 13 can be distributed uniformly over the sole surface or honeycomb body surface or they can be provided only in the edge area. Also, the edge area of covering element 9, in comparison with the remaining surface of covering element 9, can be provided with openings 13 of greater cross section Thus, a better gas exchange on the sides of the foot is guaranteed. Upper cover element 9 can also be of net-like character. A separate honeycomb body 4, according to FIG. 6, can be provided in each of ball area 14 and heel area 15, for which purpose midsole 1 has corresponding recesses 2.

To guarantee a good gas exchange upward toward the foot, preferably, an insole is provided which is gas-permeable, for example being made of felt or of open-pore and/or, optionally, of additionally perforated foam. The gas-permeable insole can exchangeably be applied to the honeycomb body or bodies (4).

Even if in the embodiments according to FIGS. 1 and 3 to 6 the honeycomb body 4, 4' is directly inserted in one or more corresponding recesses of midsole 1, 1', embodiments are, of course, possible, in which a honeycomb body is applied above or below midsole 1 and thus forms a separate midsole layer, such as heel wedge 31. A drawing representation of this embodiment variant is not shown.

These and further objects, features and advantages of the present invention will become more obvious from the following description when taken in connection with the accompanying drawings which show, for purposes of illustration only, several embodiments in accordance with the present invention.

We claim:

1. In a shoe of the type having a shoe sole which is composed of an outsole, a midsole having a body formed of elastically springy material, an insole, and a honeycomb body with self-supporting cell walls oriented at least approximately perpendicular to an outer surface of the outsole, said honeycomb body being incorporated within the body of the midsole, the improvement wherein the cell walls are constructed in a manner enabling a gas exchange between each pair of adjacent honeycomb cells through each cell wall between them as a means for producing a controlled air cushion effect.

2. Shoe according to claim 1, wherein at least the cell walls of the honeycomb body are formed of an open-pore foam.

3. Shoe according to claim 1, wherein at least one gas-permeable opening is provided in each cell wall.

4. Shoe according to claim 3, wherein each opening is round and has a diameter of about 0.1 mm to 2 mm.

5. Shoe according to claim 3, wherein the cross sectional area of each opening is about 0.0075 $mm^2$ to 3.0 $mm^2$.

6. Shoe according to claim 3, wherein each opening is slot-shaped and has a height of 1 mm to 3 mm.

7. Shoe according to claim 1, wherein the honeycomb body is surrounded by a peripheral edge wall.

8. Shoe according to claim 7, wherein said edge wall is gas-impermeable.

9. Shoe according to claim 7, wherein said edge wall is gas-permeable.

10. Shoe according to claim 9, wherein at least one opening for a lateral gas exchange with the outside atmosphere is provided in said peripheral edge wall.

11. Shoe according to claim 10, wherein an underside of the honeycomb body is provided with a gastight covering.

12. Shoe according to claim 1, wherein the honeycomb body is formed of an injection molded compressible, elastic material.

13. Shoe according to claim 12, wherein the upper surface of honeycomb body is provided with a covering element.

14. Shoe according to claim 13, wherein said covering element is an elastically flexible sheet with a thickness of about 0.1 mm to 3.0 mm.

15. Shoe according to claim 13, wherein said covering element is gas-permeable.

16. Shoe according to claim 15, wherein said covering element is formed of an open-pore foam.

17. Shoe according to claim 15, wherein said upper covering element is provided with at least one gas-permeable opening per honeycomb cell.

18. Shoe according to claim 17, wherein said upper covering element is a net.

19. Shoe according to claim 17, wherein said upper covering element is formed of a nonwoven fabric.

20. Shoe according to claim 17, wherein openings in the covering element are provided only in an edge area of the honeycomb body.

21. Shoe according to claim 17, wherein the size of openings in the cover element that are located over an edge area of the honeycomb body are greater than the size of openings located over remaining areas of the honeycomb body.

22. Shoe according to claim 1, wherein the midsole has at least one recess in at least one of a heel area and a ball area of the shoe, a honeycomb body being disposed in each recess.

23. Shoe according to claim to 22, wherein each honeycomb body extends completely across the midsole except for a side edge of the midsole of about two to ten mm wide.

24. Shoe according to claim 23, wherein a gas-permeable insole overlies every honeycomb body.

25. Shoe according to claim 24, wherein the gas-permeable insole is exchangeably mounted.

* * * * *